US006868813B2

(12) United States Patent
Zimmermann et al.

(10) Patent No.: US 6,868,813 B2
(45) Date of Patent: Mar. 22, 2005

(54) CONNECTING PIECE

(75) Inventors: Helmut Zimmermann, Hösslinswart (DE); Michael Joos, Fellbach (DE); Andreas Radtke, Bad Cannstatt (DE); Stefan Leuze, Remshalden (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 10/396,421

(22) Filed: Mar. 26, 2003

(65) Prior Publication Data

US 2003/0183186 A1 Oct. 2, 2003

(30) Foreign Application Priority Data

Mar. 26, 2002 (DE) ..... 102 13 415

(51) Int. Cl.[7] ..... F02M 35/10
(52) U.S. Cl. ..... 123/184.46; 123/590
(58) Field of Search ..... 123/184.23, 590, 123/184.21, 184.61, 184.46

(56) References Cited

U.S. PATENT DOCUMENTS 4,711,225 A 12/1987 Holderle et al.
5,065,708 A * 11/1991 Wehle et al. ..... 123/73 C
5,474,039 A * 12/1995 Doragrip ..... 123/184.55
6,073,609 A * 6/2000 Buswell et al. ..... 123/306

* cited by examiner

*Primary Examiner*—Andrew M. Dolinar
*Assistant Examiner*—Katrina B. Harris
(74) *Attorney, Agent, or Firm*—Walter Ottesen

(57) ABSTRACT

An elastic connecting piece (1) is mounted between a carburetor (4) and an inlet channel (3) of an internal combustion engine (2). The engine (2) is especially an engine of a portable handheld motor-driven work apparatus such as a motor-driven chain saw, cutoff machine or the like. The connecting piece (1) includes a peripherally extending expansion fold (5) arranged between its ends in order to compensate for changes in length. The expansion fold (5) subdivides the connecting piece (1) into a carburetor-end section (6) and into an engine-end section (7). The annular gap (28) of the expansion fold (5) can be bridged by a seal lip (8). The connecting piece (1) includes a peripherally extending seal seat (9) of axial length (g) in the region of the expansion fold (5). The seal lip (8) can be placed in seal-tight contact with the seal seat (9) and substantially closes the expansion fold (5) fluid tight to the interior space of the connecting piece (1).

21 Claims, 4 Drawing Sheets

CONNECTING PIECE

FIELD OF THE INVENTION

The invention relates to a connecting piece between a carburetor and an inlet channel of an internal combustion engine of a handheld portable work apparatus such as a motor-driven chain saw, cutoff machine or the like.

BACKGROUND OF THE INVENTION

An air/fuel mixture flows through the connecting piece from the carburetor to the combustion chamber during operation of the internal combustion engine. A portion of the fuel, especially long-chain hydrocarbons, deposits on the inner wall of the connecting piece and forms a fuel film. Fuel can also collect in the expansion fold of the connecting piece. When swinging the work apparatus, especially at idle, an enrichment of the mixture can occur because of fuel entrained from the connecting piece. A sudden mixture enrichment can lead to disturbances in the smooth running of the engine up to a stalling thereof especially in small work apparatus having a low mass moment of inertia.

A connecting piece between a carburetor and the combustion chamber is disclosed in U.S. Pat. No. 4,711,225. This connecting piece is made of elastic material and has an expansion fold. A guide ring is arranged in the region of the expansion fold in the carburetor-end section. The inner periphery of this guide ring passes seamlessly into the engine-end section. Knurling is provided in a region of the connecting piece which prevents the formation of an uninterrupted fuel film. In this way, the fuel film, which has deposited on the inner wall of the connecting piece, is prevented from suddenly reaching the combustion chamber.

It has, however, been shown that not only the fuel film, which has deposited on the inner wall, can lead to a sudden enrichment of the mixture but also fuel, which collects in the expansion fold, can suddenly be supplied to the combustion chamber and lead to a stalling of the engine.

SUMMARY OF THE INVENTION

It is an object of the invention to provide a connecting piece wherein a mixture enrichment because of fuel stored in the connecting piece is avoided.

The elastic connecting piece of the invention is for connecting a carburetor to an inlet channel of an internal combustion engine of a portable handheld motor-driven work apparatus. The connecting piece includes: an annular conduit-like member defining a longitudinal direction; the annular conduit-like member having a peripherally extending expansion fold for compensating for relative position changes between the carburetor and the engine; the expansion fold defining an annular gap and subdividing the conduit-like member into a carburetor-end section and an engine-end section; the annular conduit-like member having a seal lip and a peripherally extending seal seat in the region of the expansion fold and the seal seat having an axial length (g); and, the seal lip coming into contact engagement with the seal seat when the expansion fold changes in length and the seal lip bridges the gap thereby substantially closing the seal fluid tight to the interior of the annular conduit-like member.

No fuel stored in the expansion fold can pass therefrom into the connecting piece because of the substantially fluid-tight closure of the expansion fold by the seal lip in contact engagement with the seal seat. The length of the expansion fold can be changed from a pressed (shortened) length to an expanded length. In the built-in state, the expansion fold has the pressed length. No external loads operate on the connecting piece in the built-in state. For slight loads which occur especially at low rpms, the expansion fold is reliably closed because of this measure. A pressing of the connecting piece starting from the built-in state can be taken up by the elasticity of the material. The danger of a tearing of the connecting piece during expansion is minimized because the permissible expansion path is increased from the pressed built-in state compared to a built-in state having a mean length of the expansion fold.

The seal seat is formed as an annularly-shaped step and a section of the seal seat and a section of the seal lip run parallel to the inner contour of the connecting piece. The expansion fold can remain tightly closed in a specific region because of the parallel course of seal seat and seal lip. In this specific region, the expansion fold is expanded from the pressed position. An excellent sealing of the expansion fold is achieved in that, in the section of the sealing lip, which runs parallel to the inner contour of the connecting piece, the outer diameter of the sealing lip is at least as large as the inner diameter of the seal seat in this section.

It is practical that, in the pressed length of the expansion fold, the inner diameter of the seal lip corresponds to the inner diameter of the connecting piece section bordering on the seal seat and the seal lip substantially covers the seal seat, especially completely. With the configuration of the inner contour with an almost seamless transition from the carburetor-end section to the engine-end section, fuel is prevented from collecting at the transition which fuel is not immediately supplied to the engine. It has been determined that for equal diameters of the seal lip and the bordering connecting stub section, also narrow gaps can be overcome by the fuel while the fuel collects on the overhanging seal lip.

For the pressed expansion fold, it is advantageous that the volume enclosed by the expansion fold is virtually zero. When pressing the expansion fold, fuel, which has collected in the expansion fold, is thereby slowly pressed out of the expansion fold and supplied to the engine. Accordingly, no fuel can exit suddenly from the expansion fold when the expansion fold expands and disturb the smooth running of the engine. It is practical to provide the seal lip on the carburetor-end section of the connecting piece and the seal lip is directed in the direction of the engine-end section. The expansion fold has an almost V-shaped cross section directed outwardly and the wall thickness of the expansion fold varies in the direction of the symmetry axis of the carburetor-end section and the expansion fold has the minimum wall thickness at its greatest periphery. It has been shown that the danger of tearing of the expansion fold is present especially at low temperatures for expansion folds having a constant wall thickness, especially in the region of the greatest periphery. By configuring the expansion fold to have a minimum wall thickness at the largest diameter, the expansion fold is heated the most in this region during deformation and therefore the danger of a tear is reduced. The minimum wall thickness is approximately from 0.8 mm to 1.2 mm.

The flow cross section in the interior of the connecting piece is almost constant over the entire length of the connecting piece when the expansion fold is collapsed. In this way, constant flow velocities in the connecting piece are obtained. Knurling is applied to the inner surface of the connecting piece in the carburetor-end section. The knurling functions to store fuel which is especially drawn in by suction with a sudden closure of a throttle flap mounted in the carburetor and this can lead to the condition that the idle rpm is not reached spontaneously. The knurling can store the excess fuel and give up this fuel little by little. Grooves run in the longitudinal direction of the connecting piece on the inner contour thereof in order to prevent fuel droplets from forming on the inner walls of the connecting piece. The grooves run at least over almost the length of a section of the connecting piece, especially, over the total length of the connecting piece. The grooves facilitate the flow-off of fuel to the engine. A seal collar is arranged especially at the end of the connecting piece facing the engine. A thickening is arranged on the sealing collar at an upper region of the connecting piece at the transition from the engine-end section. The thickening is disposed above an almost elliptical cross section of the connecting piece. The thickening prevents a snap-in of the connecting piece in this region.

The carburetor-end section has a circularly-shaped flow cross section and the engine-end section has a circularly-shaped section at the end facing toward the expansion fold and a flow cross section which departs from the circular shape at the end facing toward the engine. This flow cross section at the end facing toward the engine is especially an almost elliptical flow cross section.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
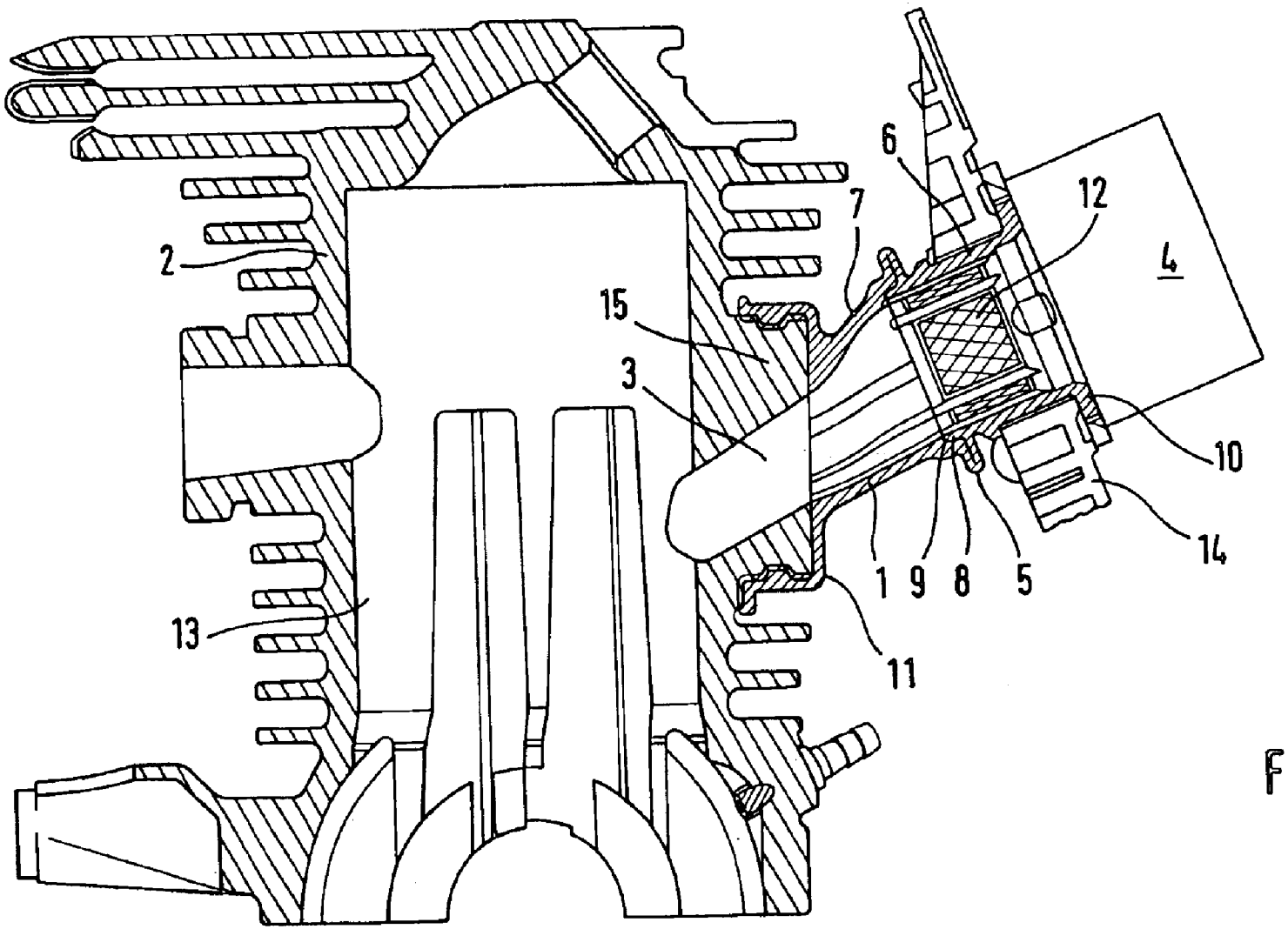
FIG. 1 is a section view taken through a cylinder of a two-stroke engine having a connecting piece mounted on the intake stub and shown in the pressed or collapsed state together with a carburetor shown schematically.

FIG. 1 shows an internal combustion engine 2 which is configured as a two-stroke engine. An inlet channel 3 opens into the cylinder 13 of the engine 2 and supplies an air/fuel mixture to the engine. The air/fuel mixture is prepared in the carburetor 4 and is supplied to the inlet channel 3 via the connecting piece 1. The carburetor 4 is fixed to a housing part 14 which is movably mounted relative to the engine 2. The connecting piece 1 is made of elastic material and functions to compensate for the relative position changes between the carburetor 4 and the engine 2. For this purpose, the connecting piece 1 has an expansion fold 5 whose length is variable from the pressed or collapsed length (a) shown in FIG. 2 to the expanded length (b) shown in FIG. 3. The expansion fold 5 can also be expanded beyond the length shown in FIGS. 3 and 4.

The expansion fold 5 subdivides the connecting piece 1 into a carburetor-end section 6 and into an engine-end section 7. The carburetor-end section 6 includes a circularly-shaped flow cross section while, in the engine-end section 7, the cross-sectional shape passes from the circular form at the expansion fold 5 to an almost elliptical form at the interface to the inlet channel 3. The lower region 18 of the connecting piece 1 shown in FIG. 2 runs approximately along a straight line over the entire length of the connecting piece 1 and approximately parallel to the symmetry axis 27 of the carburetor-end section 6. The change of the cross-sectional shape is achieved via an arched portion of the upper region 19 in the interior of the connecting piece 1. The cross-sectional area in the interior of the connecting piece 1 is constant over the entire length thereof. However, it can be advantageous to vary the cross-sectional area over the length of the connecting piece 1.

Figure 3:
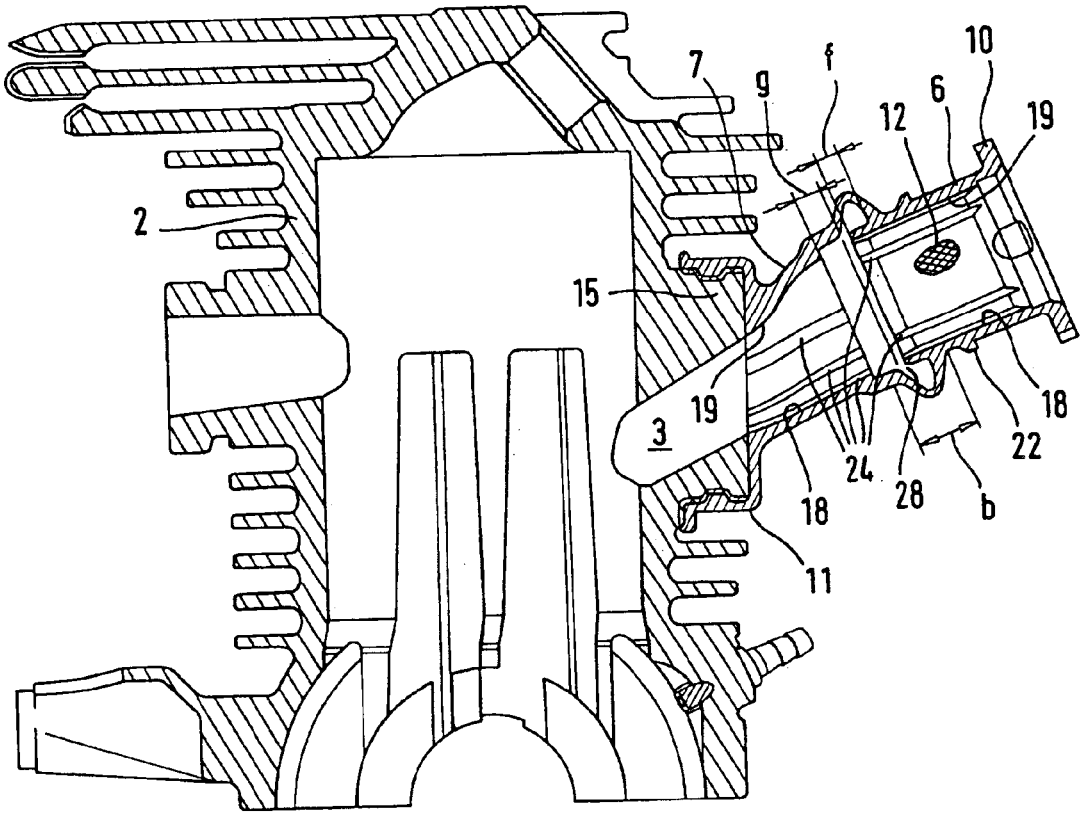
FIG. 3 is a section view taken through a cylinder of a two-stroke engine having a connecting piece mounted on the intake stub with the connecting piece shown having an expanded expansion fold; and, FIG. 4 is an enlarged section view of the connecting piece of FIG. 3.
Figure 4:
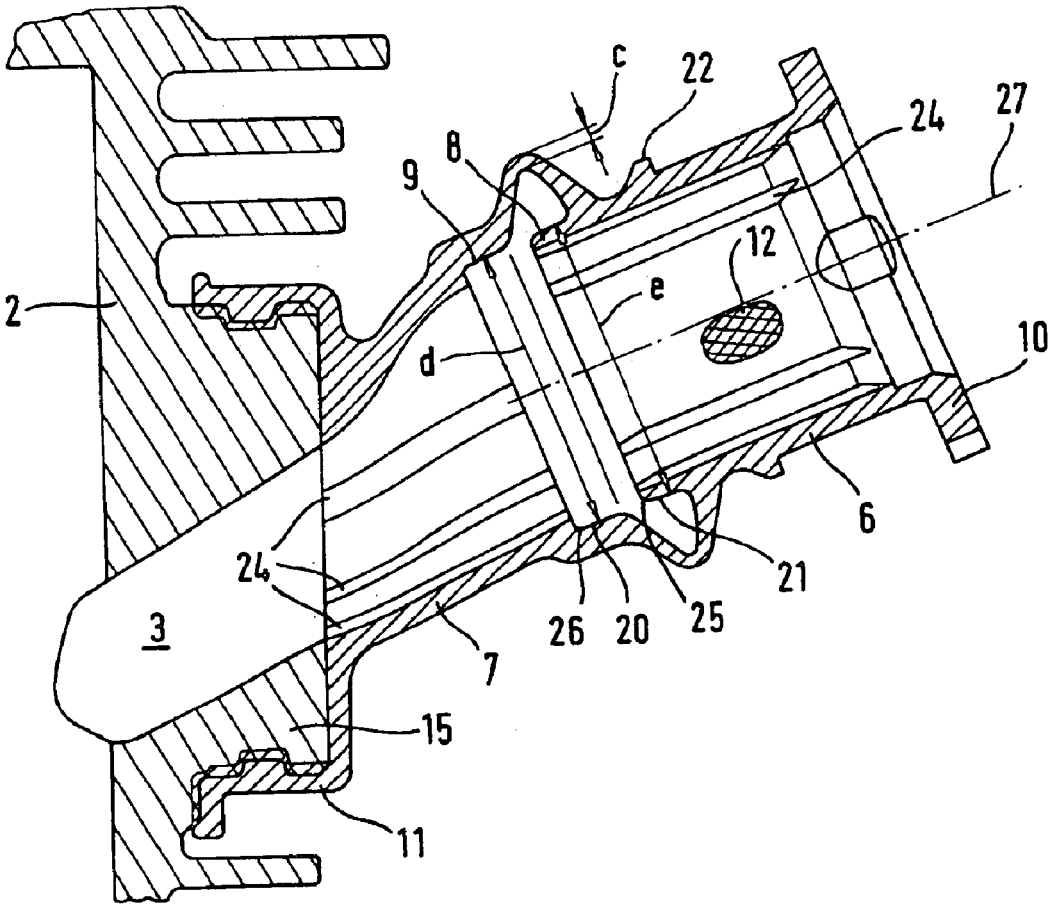

The expansion fold 5 is configured as an outwardly projecting bead having a V-shaped form. This bead forms the annular gap 28 and is shown in FIG. 3. The wall thickness of the expansion fold 5 is constant in the peripheral direction but varies in the longitudinal direction of the connecting piece and has a minimum wall thickness (c) at the largest periphery as shown in FIG. 4. The minimum wall thickness (c) amounts favorably to 0.8 mm to 1.2 mm. However, it can also be advantageous to configure the expansion fold 5 to have a constant wall thickness over its entire length.

The connecting piece 1 includes a seal lip 8 which is arranged on the carburetor-end section 6 and defines an extension of the carburetor-end section 6 in the direction toward the engine-end section 7. The annular gap 28 can be bridged by the seal lip 8.

In FIG. 4, the expansion fold 5 is shown in the expanded position. A seal seat 9 is arranged on the engine-end section 7 and is configured as an annularly-shaped step and runs parallel to the inner contour of the connecting piece 1 in a section 20. The seal lip 8 is arranged at the carburetor-end section 6 and likewise has a section 21 configured parallel to the inner contour in the direction of the symmetry axis. This section 21 and section 20 of the seal seat 9 coact and close the expansion fold 5 fluid tight when the sections 20 and 21 overlap in the direction of the symmetry axis 27. The outer diameter (e) of the seal lip 8 is greater than the inner diameter (d) of the seal seat 9 so that an excellent seal is obtained. The seal lip 8 is configured to be rounded at its forward edge 25 in order to avoid a clamping of the seal lip 8 on the seal seat 9 when the expansion fold 5 is pressed or collapsed. The seal seat 9 includes a corresponding rounded portion 26 to make possible a complete covering of the seal seat 9 by the seal lip 8.

Figure 2:
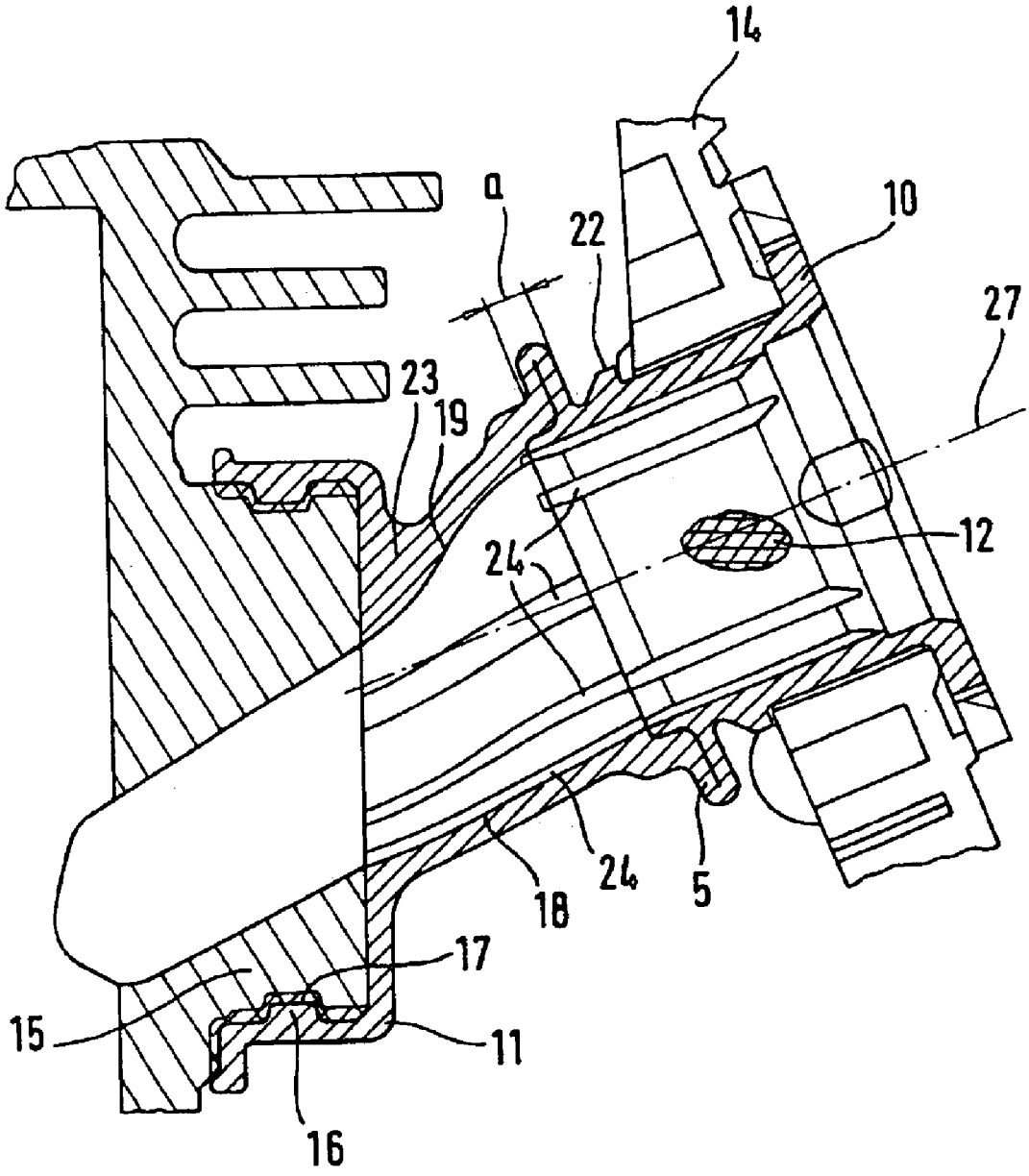
FIG. 2 is an enlarged section view of the connecting piece of FIG. 1.

The expansion fold 5 is collapsed or pressed together in the built-in state and is closed by the seal lip 8 in the seal seat 9 as shown in FIGS. 1 and 2. The volume of the expansion fold 5 is virtually zero in the collapsed or pressed state in order to prevent fuel from being stored in the expansion fold 5 which can then suddenly be supplied to the engine 2 especially when the expansion fold 5 expands. For this purpose, the length (f) of the seal lip 8 corresponds to the length (g) of the seal seat 9 as shown in FIG. 3. When the expansion fold 5 is collapsed, the fuel, which is possibly collected in the expansion fold, is completely displaced. Seal lip 8 and the bordering engine-end section 7 of the connecting piece 1 have the same inner diameter so that no fuel droplets can collect at the interface.

An edge 22 is arranged at the outer contour of the carburetor-end section 6 and this edge 22 functions to tightly clamp the connecting piece 1 behind the housing part 14 in the collapsed or pressed state during assembly. If the connecting piece 1 is pressed starting from the built-in state, this pressing is not compensated by the expansion fold 5 but by the elasticity of the connecting piece 1.

The connecting piece 1 is fixed with a seal collar 11 at the inlet channel 3. The seal collar 11 engages around the intake stub 15. To provide an axial fixation, an edge 16, which is provided at the seal collar 11, engages into a slot 17 arranged on the intake stub 15. The approximately elliptical cross section of the connecting piece 1 passes seamlessly into the cross section of the inlet channel 3. A thickening 23 is provided on the upper region 19 at the transition of the engine-end section 7 into the seal collar 11 in order to avoid a snap-in of the connecting piece 1 when subjected to intense mechanical load.

The connecting piece is fixed between the housing part 14 and the carburetor 4 with the connecting flange 10. It is practical that the flow cross section in the carburetor 4 passes approximately seamlessly into the cross section in the connecting piece 1. The carburetor-end section 6 includes knurling 12 on its inner surface. The knurling 12 can also be applied in the engine-end section 7; however, the manufacture of knurling is more complex in this section and is not necessary for the function of the storage of fuel.

Grooves 24 are arranged in the longitudinal direction of the connecting piece 1. The grooves 24 can extend over the entire length of the connecting piece 1. However, it can be advantageous that the grooves 24 extend only over one section (6, 7) or a component region of a section (6, 7). Grooves 24 are arranged in the lower region 18 as well as on both sides thereof as shown in FIG. 3. These grooves 24 extend from just under the connecting flange 10 up to the inlet channel 3 of the engine 2; whereas, the grooves 24, which are arranged laterally and in the upper region 19, extend only over the engine-end section 7, that is, over the greater portion of the carburetor-end section 6. The grooves 24 can have a V-shaped cross section in order to provide a good run off of fuel. However, it can be advantageous to configure the grooves 24 to have a trough-shaped cross section.

It is understood that the foregoing description is that of the preferred embodiments of the invention and that various changes and modifications may be made thereto without departing from the spirit and scope of the invention as defined in the appended claims.

What is claimed is:

1. An elastic connecting piece for connecting a carburetor to an inlet channel of an internal combustion engine of a portable handheld motor-driven work apparatus, said connecting piece comprising:

an annular conduit-like member defining a longitudinal direction and having an interior wall surface;

said annular conduit-like member having a peripherally extending expansion fold for compensating for relative position changes between said carburetor and said engine;

said expansion fold defining an annular gap and subdividing said conduit-like member into a carburetor-end section and an engine-end section;

said annular conduit-like member having a seal lip and a peripherally extending seal seat in the region of said expansion fold and said seal seat having an axial length (g);

said seal lip coming into contact engagement with said seal seat when said expansion fold changes in length and said seal lip bridges said gap thereby substantially closing the seal fluid tight to the interior of said annular conduit-like member; and, said seal seat being configured as an annularly-shaped step for receiving said seal lip so as not to cause an obstruction to flow along said interior wall surface where said seal seat and said seal lip coact to close said seal.

2. The elastic connecting piece of claim 1, wherein said expansion fold has a length which can change from a collapsed length (a) to an expanded length (b) and said expansion fold has said collapsed length (a) when said connecting piece is built in.

3. The elastic connecting piece of claim 1, wherein said seal seat has a section thereof extending parallel to the inner contour of said annular conduit-like member; and, said seal lip has a section thereof extending parallel to said inner contour of said annular conduit-like member.

4. The elastic connecting piece of claim 3, wherein said seal seat has an inner diameter (d) in said section thereof; and, said seal lip has an outer diameter (e) in said section thereof at least as large as said inner diameter (d).

5. The elastic connecting piece of claim 2, wherein said seal lip has an inner diameter at said collapsed length (a) which corresponds to the inner diameter of the section of said annular conduit-like member which borders on said seal seat and said seal lip substantially covers said seal seat.

6. The elastic connecting piece of claim 5, wherein said seal lip completely covers said seal seat when said expansion fold is at said collapsed length (a).

7. The elastic connecting piece of claim 2, wherein said expansion fold encloses a volume which is almost zero when said expansion fold is at said collapsed length (a).

8. The elastic connecting piece of claim 2, wherein said seal lip is arranged on said carburetor-end section and is directed toward said engine-end section.

9. The elastic connecting piece of claim 1, wherein said carburetor-end section defines a symmetry axis; said expansion fold has an approximately V-shaped cross section directed outwardly to an outermost periphery; and, said expansion fold has a wall thickness which varies in a direction toward said symmetry axis and said wall thickness is a minimum wall thickness (c) at said outermost periphery of said expansion fold.

10. The elastic connecting piece of claim 9, wherein said minimum wall thickness (c) lies in a range of approximately 0.8 mm to 1.2 mm.

11. The elastic connecting piece of claim 2, wherein said annular conduit-like member has an approximately constant flow cross section in the interior thereof over the total length of said connecting piece when said expansion fold is at said collapsed length (a).

12. The elastic connecting piece of claim 1, wherein said carburetor-end section has an interior wall surface; and, a knurled region is applied to said interior wall surface of said carburetor-end section.

13. The elastic connecting piece of claim 1, wherein said annular conduit-like member has an interior wall surface; and, a plurality of grooves are formed in said interior wall surface running in said longitudinal direction.

14. The elastic connecting piece of claim 13, wherein said grooves extend over the entire length of each of said carburetor-end section and said engine-end section.

15. The elastic connecting piece of claim 13, wherein said grooves extend over the entire length of said annular conduit-like member.

16. The elastic connecting piece of claim 1, wherein said annular conduit-like member has a seal collar formed on said engine-end section on the end thereof facing toward said engine; and, said annular conduit-like member has an upper region and has a thickening at said upper region in the transition region from said engine-end section to said seal collar.

17. The elastic connecting piece of claim 1, wherein said carburetor-end section has a circular flow cross section and said engine-end section has an end facing toward said engine; said engine-end section has a flow cross section at said end which departs from a circularly-shaped flow cross section; and, said engine-end section has a circular flow cross section at the end thereof facing toward said expansion fold.

18. The elastic connecting piece of claim 17, wherein said flow cross section at said end is approximately an elliptical flow cross section.

19. An elastic connecting piece for connecting a carburetor to an inlet channel of an internal combustion engine of a portable handheld motor-driven work apparatus, said connecting piece comprising:

an annular conduit-like member defining a longitudinal direction;

said annular conduit-like member having a peripherally extending expansion fold for compensating for relative position changes between said carburetor and said engine;

said expansion fold defining an annular gap and subdividing said conduit-like member into a carburetor-end section and an engine-end section;

said annular conduit-like member having a seal lip and a peripherally extending seal seat in the region of said expansion fold and said seal seat having an axial length (g);

said seal lip coming into contact engagement with said seal seat when said expansion fold changes in length and said seal lip bridges said gap thereby substantially closing the seal fluid tight to the interior of said annular conduit-like member;

said seal seat being configured as an annularly-shaped step having a section thereof extending parallel to the inner contour of said annular conduit-like member; and, said seal lip having a section thereof extending parallel to said inner contour of said annular conduit-like member.

20. An elastic connecting piece for connecting a carburetor to an inlet channel of an internal combustion engine of a portable handheld motor-driven work apparatus, said connecting piece comprising:

an annular conduit-like member defining a longitudinal direction;

said annular conduit-like member having a peripherally extending expansion fold for compensating for relative position changes between said carburetor and said engine;

said expansion fold defining an annular gap and subdividing said conduit-like member into a carburetor-end section and an engine-end section;

said expansion fold having a length which can change from a collapsed length (a) to an expanded length;

said annular conduit-like member having a seal lip and a peripherally extending seal seat in the region of said expansion fold and said seal seat having an axial length (g);

said seal lip coming into contact engagement with said seal seat when said expansion fold changes in length and said seal lip bridges said gap thereby substantially closing the seal fluid tight to the interior of said annular conduit-like member; and, said expansion fold enclosing a volume which is almost zero when said expansion fold is at said collapsed length (a).

21. An elastic connecting piece for connecting a carburetor to an inlet channel of an internal combustion engine of a portable handheld motor-driven work apparatus, said connecting piece comprising:

an annular conduit-like member defining a longitudinal direction;

said annular conduit-like member having a peripherally extending expansion fold for compensating for relative position changes between said carburetor and said engine;

said expansion fold defining an annular gap and subdividing said conduit-like member into a carburetor-end section and an engine-end section;

said annular conduit-like member having a seal lip and a peripherally extending seal seat in the region of said expansion fold and said seal seat having an axial length (g);

said seal lip coming into contact engagement with said seal seat when said expansion fold changes in length and said seal lip bridges said gap thereby substantially closing the seal fluid tight to the interior of said annular conduit-like member; and, said annular conduit-like member having an approximately constant flow cross section in the interior thereof over the total length of said connecting piece when said expansion fold is collapsed.

* * * * *